United States Patent [19]

Helmus et al.

[11] 4,440,553

[45] Apr. 3, 1984

[54] AIR-FILTRATION MODULE WITH IONIZATION FOR ELIMINATION OF STATIC ELECTRICITY

[76] Inventors: Martin C. Helmus, 2525 Knollview, SW., Wyoming, Mich. 49509; Wallace L. Baker, 4505 Hersman, SE., Grand Rapids, Mich. 49506

[21] Appl. No.: 365,556

[22] Filed: Jun. 5, 1982

[51] Int. Cl.[3] ..... B03B 3/01; B03B 3/70

[52] U.S. Cl. ..... 55/126; 55/146; 55/279; 55/385 A; 422/121; 361/231

[58] Field of Search ..... 55/124, 126, 131, 132, 55/141, 146, 152, 279, 385 A; 422/121; 361/226, 229, 231, 232

[56] References Cited

U.S. PATENT DOCUMENTS

| | | | |
|---|---|---|---|
| 2,933,151 | 4/1960 | Kurtz | 55/131 |
| 2,979,158 | 4/1961 | Vlier, Jr. | 55/126 |
| 3,073,094 | 1/1963 | Landgraf et al. | 55/126 |
| 3,438,180 | 4/1969 | Klouda | 55/124 |
| 3,973,932 | 8/1976 | Alskog | 55/132 |
| 4,026,684 | 5/1977 | Finger | 55/126 |
| 4,140,498 | 2/1979 | Krause | 55/385 A |
| 4,265,641 | 5/1981 | Natarajan | 55/152 |
| 4,333,750 | 6/1982 | Helmus et al. | 55/259 |
| 4,357,150 | 11/1982 | Masuda et al. | 55/132 |

*Primary Examiner*—David L. Lacey

*Attorney, Agent, or Firm*—Glenn B. Morse

[57] ABSTRACT

A filtration module containing a filter element is provided with an ionization device on the outlet side of the filter module which utilizes the outlet grille and portions of the standard filter element as components of the ionization device.

1 Claim, 6 Drawing Figures

FIG. 2
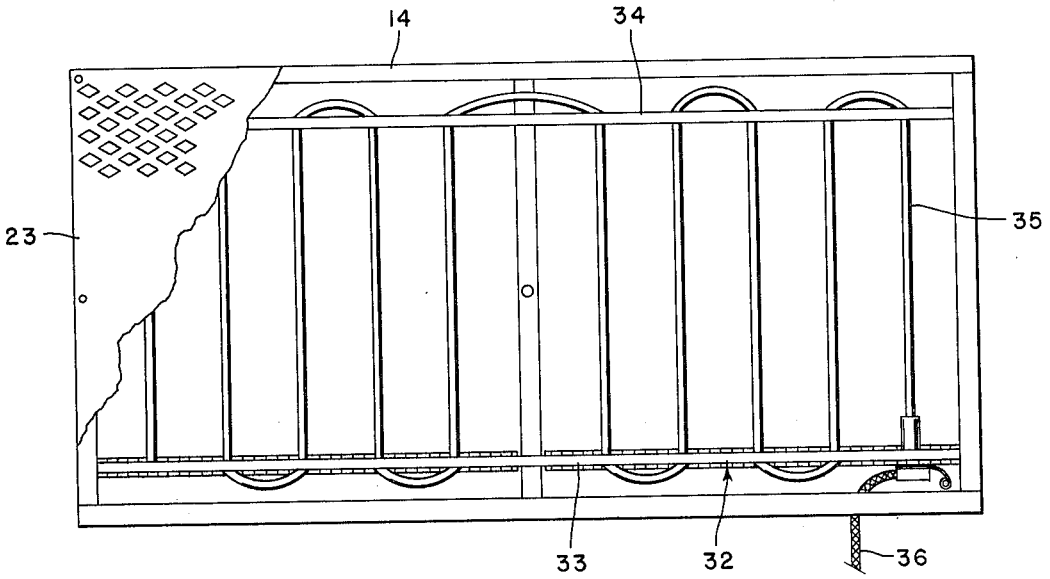
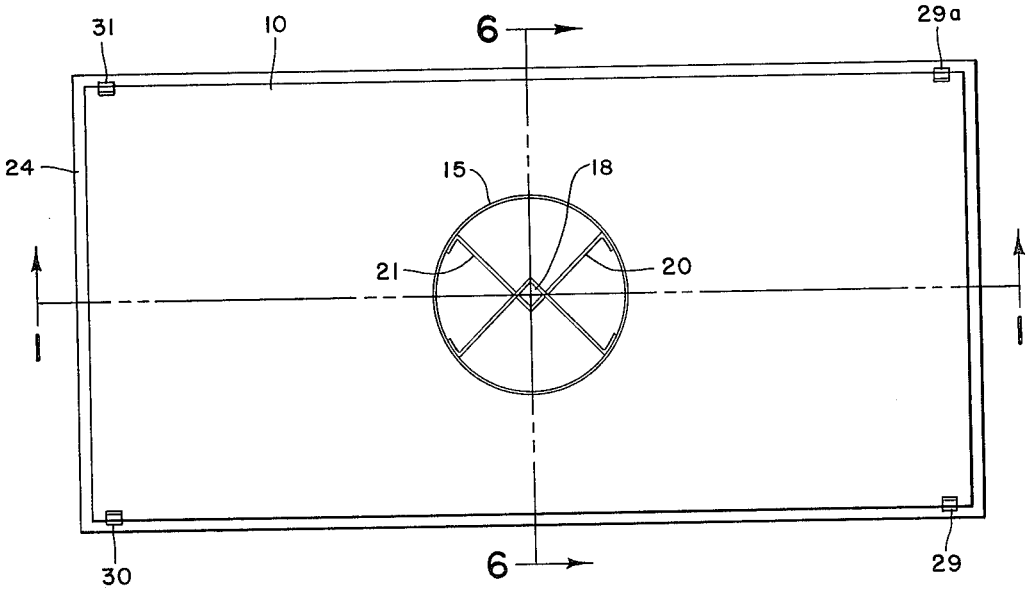
FIG. 3

AIR-FILTRATION MODULE WITH IONIZATION FOR ELIMINATION OF STATIC ELECTRICITY

BACKGROUND OF THE INVENTION

Several manufacturing and research activities require so-called "clean room" environments to avoid contamination of the articles being handled. It is standard practice to arrange a number of filtration modules in the ceiling area of a clean room, with some form of air outlet provided adjacent the floor level. Air is admitted to the filtration modules by standard ducting extending to a blower system, with the air normally being recirculated. The wide use of this type of equipment has developed a generally similar configuration for the modules, which includes some form of housing providing an equalization space between the housing intake and a filter element, and a grille defining the outlet of the module into the room. Some types of the module provide for the replacement of the filter elements from the interior of the room, and other forms of the modules are essentially throw-away assemblies that are discarded when the filter can no longer perform its function. In the latter case, it is common to utilize the wooden frame of the standard filter element as a part of the housing of the module. In both types of module, a grille of some form is mounted in a position spaced downstream from the outlet side of the filter. The standard filter element is the same in both cases, and consists of a rectangular wooden frame containing densely convoluted paper-like material separated by aluminum foil separation panels.

The filter element goes a long way toward the removal of particulate material suspended in the air flow, but can never remove all of the particles that might conceivably contaminate delicate instruments or electronic components. A valuable adjunct to clean room filtration equipment has been a type of air-ionization equipment that tends to neutralize any static charges that may develop on articles within the room so that they do not attract the suspended particles that still remain carried by the air stream, or which may exist as a result of being carried into the room by personnel, work articles, or equipment. Basically, the ionization devices consist of a group of electrostatically charged bars arranged in a generally planar configuration, with some form of ground grid disposed on opposite sides of the charged bars with respect to the direction of movement of the air. Normally, the entire air stream is subject to the influence of this assembly.

SUMMARY OF THE INVENTION

An air-filtration module has a housing defining an air passage, and a filter element disposed across this passage. On the outlet side of the filter element, an ionization unit has electrically charged bars in the path of the air flow, and ground elements on opposite sides of the bars with respect to the direction of air flow. In one form of the invention, one of these ground elements is a metallic foil employed in the filter elements; and in another form of the invention, the other ground element is a metalliic grille defining the exhaust outlet of the module.

DESCRIPTION OF THE DRAWINGS

FIG. 2 is a view of the underside of the module shown in FIG. 1, on a reduced scale, with a portion of the grille panel broken away to expose the interior arrangement.

FIG. 3 is a top view of the module shown in FIG. 1.

DESCRIPTION OF THE PREFERRED EMBODIMENTS

Figure 1:
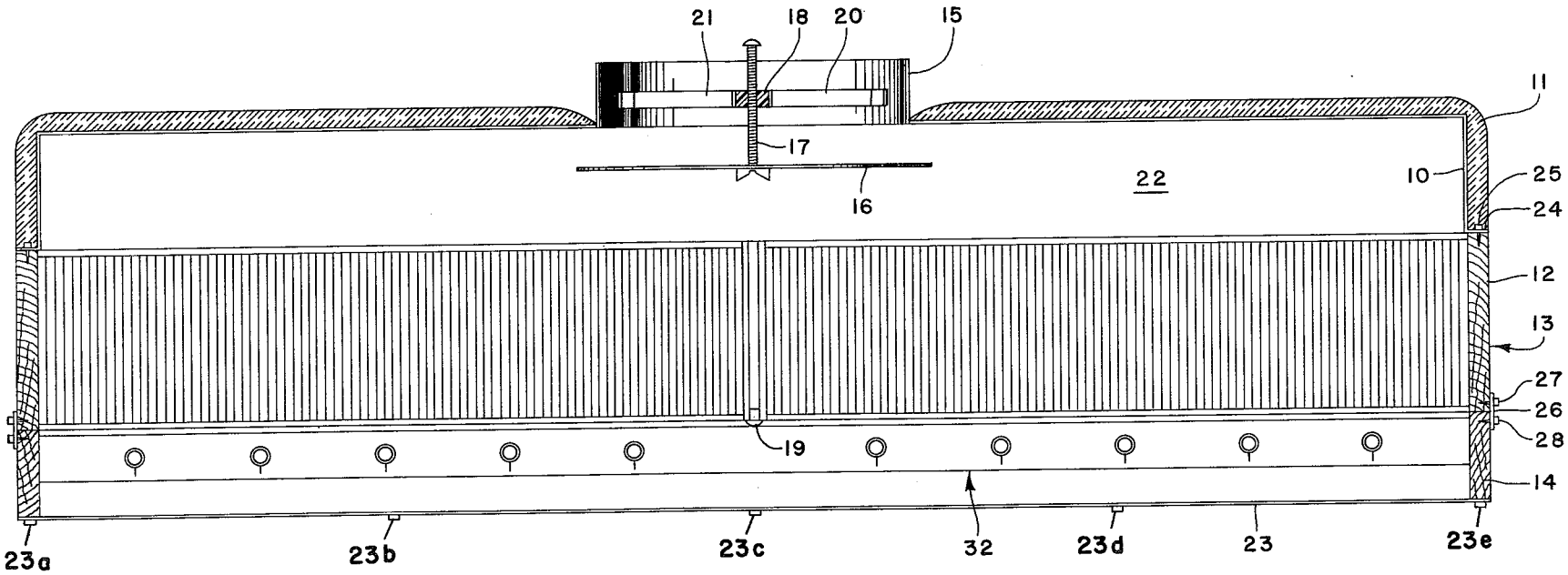
FIG. 1 is a longitudinal section through a filter module embodying the present invention, on a vertical plane.
Figure 4:
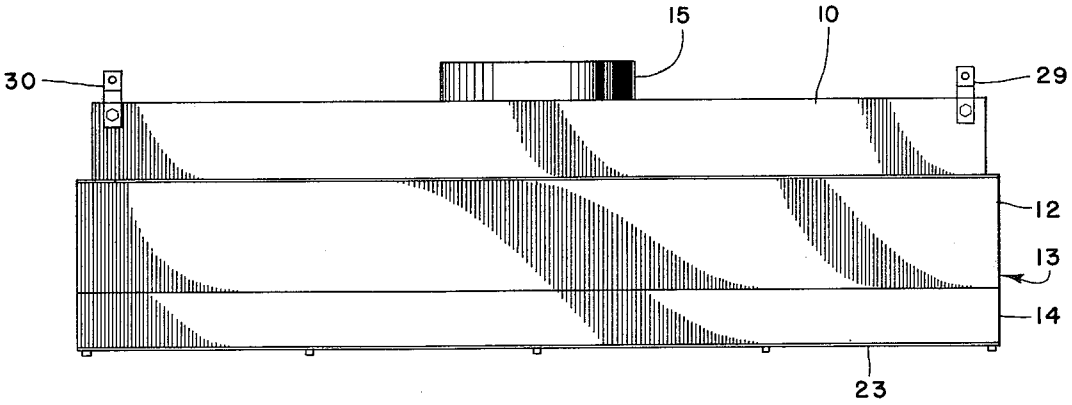
FIG. 4 is a side elevation of the module shown in FIG. 1, on a reduced scale.
Figure 5:
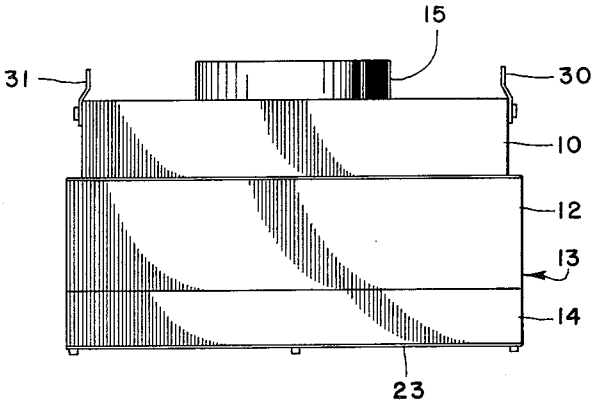
FIG. 5 is an end elevation of the module shown in FIG. 1, on a reduced scale.
Figure 6:
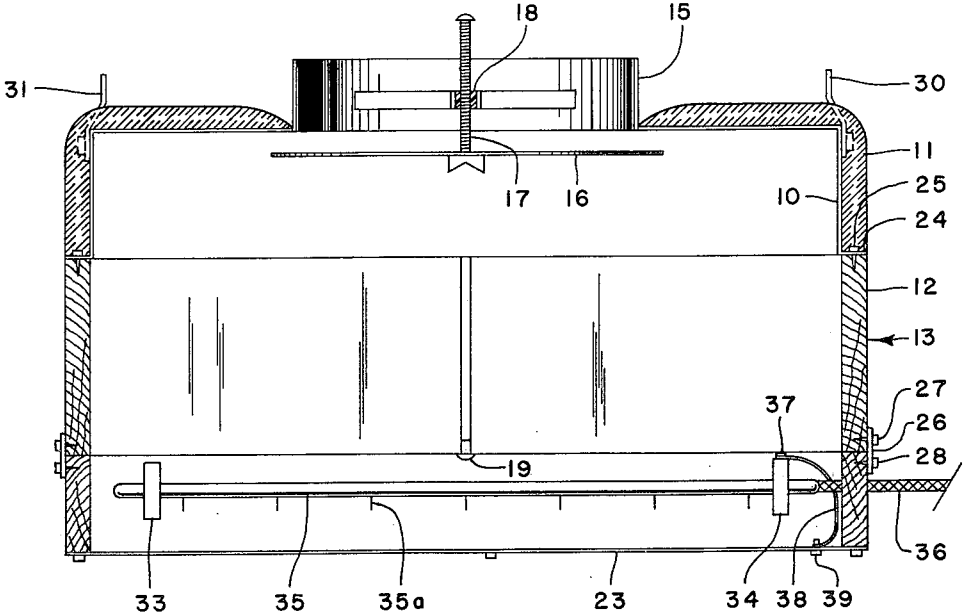
FIG. 6 is a transverse section on a vertical plane of the module shown in FIG. 1.

The filtration module illustrated in the drawings includes a housing assembly formed by the hood 10 (covered by the insulation indicated at 11), the frame 12 of the standard HEPA filter element 13, and the extension frame 14. The hood 10 is provided with an inlet collar 15 controlled by a valve plate 16 supported on the screw 17. This screw engages the central boss 18 in threaded engagement, and is manipulated through a vertical opening in the filter element 13 covered by the plug 19. Generally radial arms as indicated at 20 and 21 in FIG. 1 extend out to the collar 15 to maintain the position of the control assembly. The space 22 between the hood 10 and the filter element 13 provides for the equalization of the air flow over the top of the filter element, from which the air entering through the collar 15 passes through the filter element to exhaust into the room through the openings in the metal grille 23 secured to the bottom edge of the extension frame 14 by screws as shown at 23 *a–e* in FIG. 1. The hood 10 has a lower flange 24 secured to the top edge of the frame 12 of the filter element by a number of peripherally spaced screws 25. The extension frame 14 is secured to the frame 12 by clips as shown at 26 secured to the sides of the frame 12 by screws as shown at 27, and to the sides of the extension frame 14 by the screws indicated at 28. This type of assembly is not designed for normal replacement of the filter element 13, and is essentially at throw away assembly that may be discarded, or subject to salvage, when the filter element 13 can no longer perform its function properly. The entire unit may be suspended in position adjacent the ceiling of a room through brackets as indicated at 29–31 in FIGS. 4 and 5. Normally, there will be four of these brackets, one of these (29*a*) being concealed behind the brackets 29 and 31 in FIGS. 4 and 5. FIGS. 4 and 5, incidentally, do not show the insulaton 11 in place.

The ionization unit indicated at 32 is mounted in the space between the underside of the filter element 13 and the grille 23. The unit includes the non-conductive bars 33 and 34, the ends of which are received in convenient recesses in the walls of the extension frame 14. A conductive member 35 is received in suitable openings in the bars 33 and 34 in a serpentine configuration, and is connected to a high-voltage source (not shown) by the cable 36. The conventional form of this unit also includes a ground grid disposed on opposite sides of the plane of the charged member 35, but the present invention provides these components through a second use of the aluminum foil spacing panels conventionally interposed between the folds of the paper-like material constituting the filter body of the element 13. These foil panels emerge at the lower face of the filter element, and this foil material is contacted by the conductive clip 37 interposed between the filter element 13 and the bar 34 of the ionization unit. A wire 38 connects this clip also to the screw 39 engaging the aluminum grille 23 so that the foil and the grille form ground components on opposite sides of the plane of the charged member 35. The charged member 35 is normally provided with discharge points as indicated at 35*a*, and experience has shown that there should be a minimum of one and five-sixteenths of an inch between the ends of these points and the conductive grille 23. The ground wire or strap 38 is preferably connected to either an external ground, or to a ground wire in the cable 36. The structure of the usual grounding grids associated with the ionization unit is thus eliminated by a dual use of components performing other functions in the module. It should be noted that the incorporation of the ionization unit into the module simplifies the wiring problems, and improves the protection of the components.

We claim:

1. An air-filtration module having a housing provided with air-inlet means and an open outlet end; a filter element secured to said housing in said open end, said housing defining a space between said air-inlet means and said filter element; and grille means fixed with respect to said housing and defining an outlet for air emerging from said filter element, said grille means and filter element being spaced from each other in said housing to define a space free of filtration material, wherein the improvement comprises:

an electrostatic ionization generator fixed with respect to said housing and interposed between said filter element and said grille means, said filter element and said grille means being formed of grounding material components so as to provide ground potential on opposite sides of said ionization generator.

* * * * *